US010633164B2

(12) United States Patent
Brozell

(10) Patent No.: US 10,633,164 B2
(45) Date of Patent: Apr. 28, 2020

(54) LID FOR CONTAINERS UNDER VACUUM

(71) Applicant: Owens-Brockway Glass Container Inc., Perrysburg, OH (US)

(72) Inventor: Brian J Brozell, Maumee, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 56 days.

(21) Appl. No.: 15/849,211

(22) Filed: Dec. 20, 2017

(65) Prior Publication Data

US 2019/0185242 A1 Jun. 20, 2019

(51) Int. Cl.

| | |
|---|---|
| ***B65D 81/20*** | (2006.01) |
| ***B65D 51/16*** | (2006.01) |
| ***B65D 41/48*** | (2006.01) |
| ***B65D 43/02*** | (2006.01) |
| ***B65D 41/04*** | (2006.01) |
| ***B65D 53/02*** | (2006.01) |
| ***B65D 51/14*** | (2006.01) |

(52) U.S. Cl.

CPC ..... *B65D 81/2015* (2013.01); *B65D 41/045* (2013.01); *B65D 41/485* (2013.01); *B65D 43/0227* (2013.01); *B65D 51/145* (2013.01); *B65D 51/1677* (2013.01); *B65D 51/1683* (2013.01); *B65D 51/1688* (2013.01); *B65D 53/02* (2013.01); *B65D 2543/00092* (2013.01)

(58) Field of Classification Search

CPC ..... B65D 81/00–2015; B65D 43/00–0227; B65D 41/00–485; B65D 51/00–1683; B65D 2543/00–00092

See application file for complete search history.

(56) References Cited

U.S. PATENT DOCUMENTS

| | | | | |
|---|---|---|---|---|
| 3,685,679 | A | 8/1972 | Heffran | |
| 3,850,330 | A | 11/1974 | Koontz et al. | |
| 4,002,318 | A * | 1/1977 | Von Koch | F16H 61/0251 251/129.08 |
| 4,051,973 | A | 10/1977 | Botkin | |
| 4,111,330 | A | 9/1978 | Jordan | |

(Continued)

FOREIGN PATENT DOCUMENTS

| | | |
|---|---|---|
| DE | 2712835 A1 | 9/1978 |
| GB | 651975 | 4/1951 |

OTHER PUBLICATIONS

PCT Int. Search Report and Written Opinion, Int. Application No. PCT/US2018/063019, Int. Filing Date: Nov. 29, 2018, Applicant: Owens-Brockway Glass Container Inc., dated May 20, 2019.

*Primary Examiner* — Kareen K Thomas

(57) ABSTRACT

A closure includes an overcap having an annular skirt, and an annular wall extending inwardly from the skirt. A lid is carried by the overcap radially within the annular skirt, and includes a hub, and an annular margin extending radially outwardly with respect to the hub, and having upper and lower surfaces. An annular container seal extends circumferentially continuously around the annular margin. One or more vents may extend through the annular margin between the upper and lower surfaces thereof at one or more discrete circumferential locations radially inward with respect to the container seal. One or more vent seals may be disposed at the one or more vents between the lid and the overcap.

26 Claims, 7 Drawing Sheets

(56) References Cited

U.S. PATENT DOCUMENTS

| | | | | | |
|---|---|---|---|---|---|
| 4,362,185 | A * | 12/1982 | Kadner | F16K 1/443 | 137/516.29 |
| 5,538,220 | A * | 7/1996 | LaMarca | F16K 31/0655 | 251/129.15 |
| 5,649,687 | A * | 7/1997 | Rosas | F02M 25/0836 | 251/129.05 |
| 5,785,198 | A | 7/1998 | Credle, Jr. | | |
| 5,970,958 | A * | 10/1999 | DeLand | F02M 25/0836 | 123/520 |
| 5,979,683 | A | 11/1999 | Kobayashi et al. | | |
| 6,050,245 | A * | 4/2000 | Cook | F16K 31/0675 | 123/520 |
| 6,202,871 | B1 | 3/2001 | Kelly | | |
| 6,662,958 | B2 * | 12/2003 | German | B65D 41/3423 | 215/252 |
| 7,988,004 | B1 * | 8/2011 | Marret | B65D 47/242 | 215/252 |
| 8,550,268 | B1 * | 10/2013 | Chisholm | B65D 45/305 | 215/44 |
| 8,714,379 | B2 | 5/2014 | Grant | | |
| 9,051,074 | B2 | 6/2015 | Lonsway et al. | | |
| 9,051,088 | B2 * | 6/2015 | Chisholm | B65D 51/145 | |
| 2005/0128870 | A1 * | 6/2005 | Garcia | B65D 45/325 | 366/347 |
| 2006/0091099 | A1 | 5/2006 | Klepac et al. | | |
| 2007/0164031 | A1 * | 7/2007 | Holz | B60K 15/0406 | 220/300 |
| 2008/0203051 | A1 | 8/2008 | Dusel | | |
| 2015/0013270 | A1 | 1/2015 | Chisholm | | |

* cited by examiner

LID FOR CONTAINERS UNDER VACUUM

The present disclosure relates to closures and, more particularly, to container closures for application to containers under vacuum.

BACKGROUND

Vacuum packages typically include containers sealed by closures. Containers often include a body and a neck finish extending axially from the body to accept a closure. The body usually includes a base, a sidewall extending axially away from the base, and a shoulder between the sidewall and the neck finish. The neck finish typically includes circumferentially extending threads to cooperate with corresponding threads of the closure, and a circular end surface to cooperate with a seal on an undersurface of the closure. U.S. Pat. No. 2,244,316 illustrates a glass container and closure of this type.

BRIEF SUMMARY OF THE DISCLOSURE

The present disclosure embodies a number of aspects that can be implemented separately from or in combination with each other.

In accordance with an aspect of the present disclosure, a closure includes an overcap, including an annular skirt extending along a longitudinal axis, and an annular flange extending radially inwardly from the annular skirt. Also, the closure includes a lid carried by the overcap radially within the annular skirt, and including a hub, and an annular margin extending radially outwardly with respect to the hub, and having upper and lower surfaces. An annular container seal extends circumferentially continuously around the annular margin. In accordance with a further aspect of the present disclosure, a package includes a container, and the above-described closure coupled thereto.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION

In general, a multi-piece closure is described below for sealed coupling to a container under vacuum and for vacuum venting upon initial rotational removal of the closure from the container. A unique lid is carried by an overcap radially within an annular axially extending skirt of the overcap and radially overlapped by a radially inwardly extending flange of the overcap. Uniquely, one or more vents extend through the annular margin between upper and lower surfaces thereof at a discrete circumferential location radially inward with respect to a circumferentially continuous annular container seal at the annular margin lower surface, and one or more vent seals disposed at the vent(s) at the upper surface of the annular margin.

Figure 1:
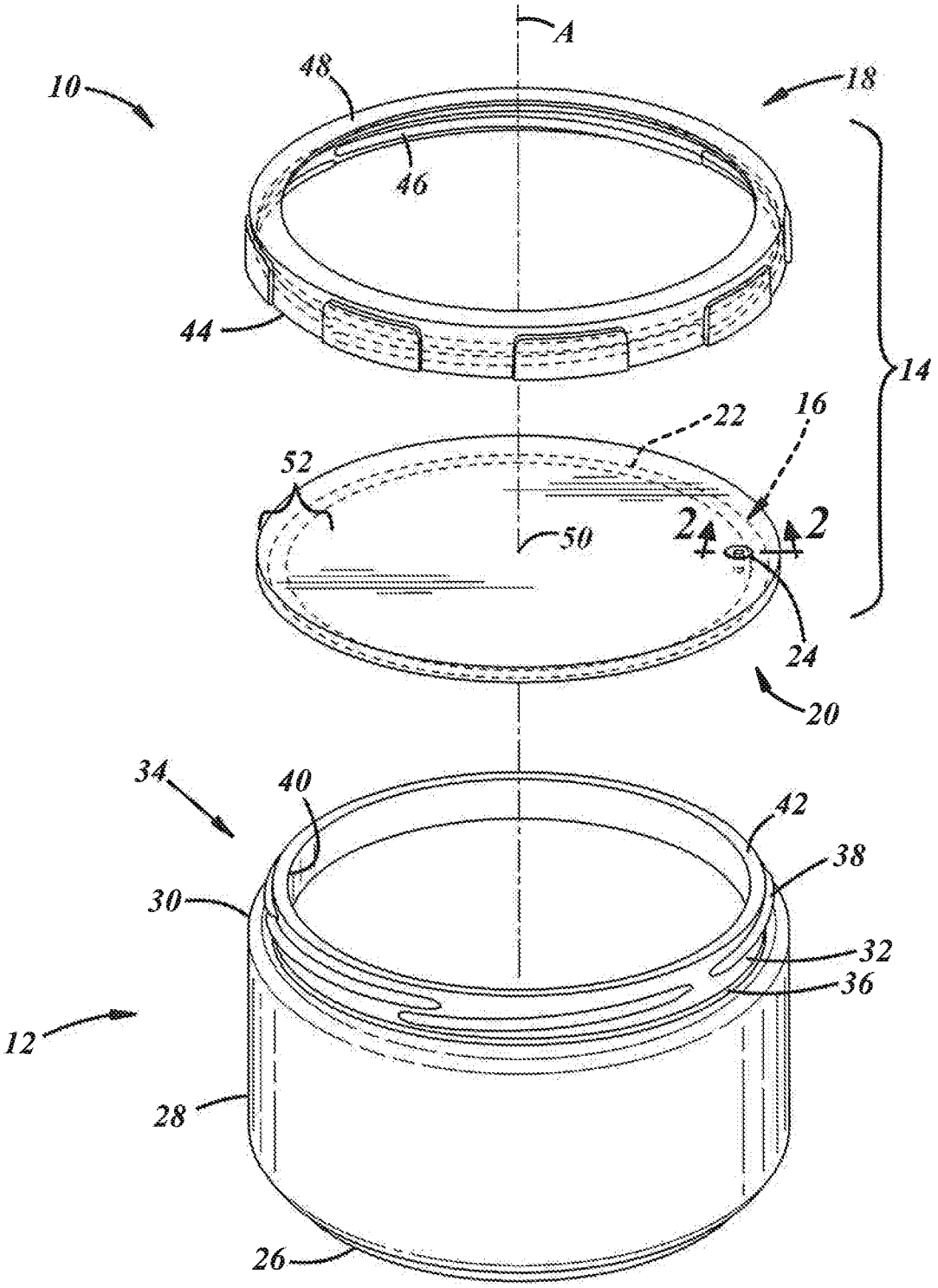
FIG. 1 is an exploded perspective view of a package in accordance with an illustrative embodiment of the present disclosure, and including a container and a closure for the container including a closure lid and a closure overcap.

With detailed reference to the drawing figures, FIG. 1 illustrates a package 10 including a container 12, and a closure 14 coupled to the container 12 to close the container 12 and including a seal 16 between the container 12 and the closure 14 to seal the closure 14 to the container 12. The container 12 may be a single, integral, article of manufacture. The closure 14 may be a multiple piece closure, which may include an overcap 18 to couple to the container 12 and a separate lid 20 disposed between the overcap 18 and the container 12 to close the container 12. The seal 16 may be a multiple portion seal, which may include a container seal 22 and a vent seal 24 that may be coupled to the container seal 22. As will be described in further detail herein below, upon rotation of the closure 14 on the container 12 in a loosening direction, the vent seal 24 becomes unseated from sealing engagement with the closure 14 such that vacuum may be released from within the package 10.

The package 10 may be used to package pickles, baby food, salsa, peppers, sauces, jams, or any other hot-fill food product(s), or other food products generally. The package 10 also may be used to package other types of products including but not limited to liquids, gels, powders, particles, and the like. The package 10 may be suitable for hot-fill applications of product at 185° F. and above, and can be developed for retort applications at temperatures of 260° F. and above. The package 10 includes a longitudinal axis A, about which the closure 14 may be rotated with respect to the container 12.

The container 12 may be composed of glass, or any other material suitable for containing food products. The container 12 includes a base 26, and a body 28 extending from the base 26, and also may include a shoulder 30 extending from the body 28. In other embodiments, however, the container body 26 need not include the shoulder 30. In any event, the container 12 also may include a neck 32 extending from the shoulder 30 (or directly from the body 28). The neck 32 includes a neck finish 34 that may include any suitable features, for example, a capping flange or bead 36 (FIG. 2), one or more external, or radially outwardly extending, closure securement elements 38 that may include lugs, bayonets, thread segments, or any other suitable features. As used herein, the phrase "thread segment" includes whole, partial, multiple, and/or one or more interrupted threads and/or thread segments. The closure securement elements 38 may include one, two, three, four, or any other suitable quantity of elements. In any case, the elements 38 collectively may extend completely circumferentially around the neck finish 34. The neck finish 34 also includes an open mouth 40 surrounded by a sealing surface 42 of the neck finish 34. The sealing surface 42 faces axially for engagement with a corresponding portion of the closure 14.

Figure 2:
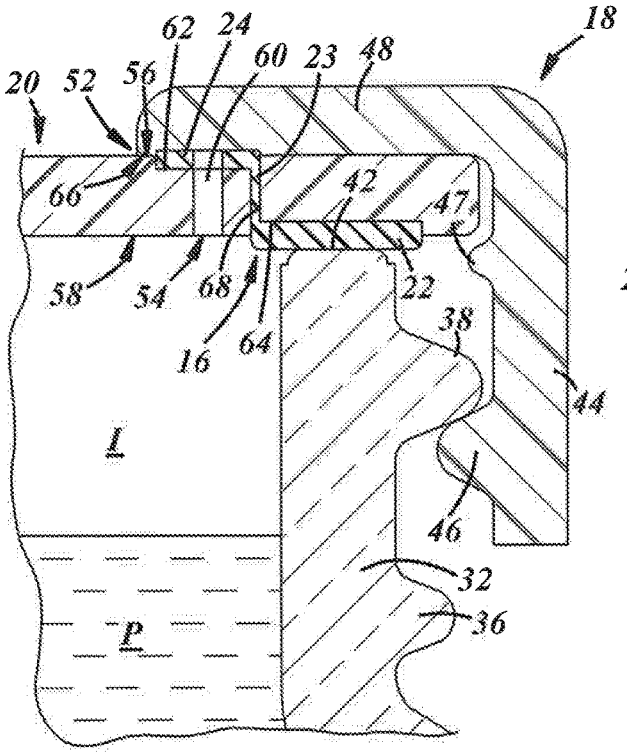
FIG. 2 is a fragmentary sectional view of the package of FIG. 1, taken from line 2-2 thereof and illustrating the package in an assembled and sealed condition.

With reference to FIG. 2, the closure 14 may be of multiple-piece construction as illustrated. Also, the closure 14 may be provided in any suitable sizes, and may be a wide-mouth type of closure when the container 12 is a wide-mouth type of container. The components of the closure 14 may be composed of metallic material, polymeric material, glass, ceramic, and/or any other material(s) suitable for use with food products. The container 12, with the closure 14 sealingly coupled thereto, establishes a package interior I to hold a product P within the package 10, for instance, under vacuum.

With reference to FIGS. 1 and 2, the overcap 18 has an annular skirt 44 with one or more internal, or radially inwardly extending, container securement elements 46 for engagement with the external securement element(s) 38 on the finish 34. The overcap 18 also has a radially inwardly directed wall extending radially inwardly from the annular skirt 44, and may be a flange 48 establishing a central aperture of the overcap 18. Notably, the overcap 18 does not include an imperforate base wall that transversely extends, completely and continuously, radially across the central longitudinal axis. The central aperture has an inner diameter that is 25-85% of an outer diameter of the skirt 44, including all ranges, sub-ranges, endpoints, and values therein. The overcap 18 further has a radially inwardly directed retainer 47 (FIG. 2) extending radially inwardly from the skirt 44 between the securement elements 46 and the flange 48 to retain the closure lid 20 to the overcap 18. The retainer 47 may include one or more radially inwardly extending beads, steps, shoulders, or the like. The overcap 18 may be composed of a polymeric material, for instance, a thermoplastic, for example, polypropylene. In other embodiments, the overcap 18 may be composed of glass, metal, or any other material suitable for use in containing food products.

The lid 20 may be a disc or plate, and may include a central hub 50 (FIG. 1), and an annular margin 52 extending radially outwardly with respect to the hub 50. The annular margin 52 may include that portion of the lid 20 that extends radially outwardly with respect to the hub 50, that is overlapped by the annular flange 48 of the overcap 18, and that is established radially outwardly of the central aperture of the overcap 18. For example, an inner diameter of the annular margin 52 may be 28-84% of an outer diameter of the lid 20, including all ranges, sub-ranges, endpoints, and values therein. The central hub 50 of the lid 20 is solid or imperforate, and can be of any suitable geometry, for instance, flat or slightly axially outwardly domed in a relaxed or vented state, and flat or slightly axially inwardly domed in an applied or vacuum state.

In contrast, and with reference to FIG. 2, the margin 52 is perforate, including one or more vents 54 extending therethrough between upper and lower surfaces 56, 58 of the lid 20, and may be planar and circular. Notably, the vent 54 is not located in the hub 50 (FIG. 1) and, more specifically, is not centrally located intersecting the central longitudinal axis (FIG. 1). The vent 54 is provided at a discrete circumferential location radially inward with respect to the circumferentially continuous annular container seal 22. The vent 54 may include a throughbore 60, and a pocket or counterbore 62 in the upper surface 56 of the lid 20. Also, the lid 20 may include an annular channel or pocket 64 in the lower surface 58 thereof. The lid 20 may be transparent to facilitate visibility of the packaged product therethrough, and may be composed of a polymeric material, for example, a thermoplastic, for instance, a BPA-free copolyester, available from Eastman Chemical Co. of Kingsport, Tenn. and named TRITAN. In other embodiments, the lid 20 may be composed of glass, metal, or any other material suitable for use in containing food products.

The seal 16 may be carried by the closure lid 20. The seal 16 includes the container seal 22 disposed for sealing engagement with the sealing surface 42 of the container 12 and with a lower surface of the lid 20. More specifically, the container seal 22 may be carried in the annular pocket 64 in the lower surface 58 of the lid 20. The seal 16 also includes the vent seal 24 disposed for sealing engagement with a lower surface 66 of the overcap flange 48 and the upper surface 56 of the lid 20. More specifically, the vent seal 24 may be carried in the counterbore 62 of the lid 20. The illustrated vent seal 24 may surround the vent 54 by surrounding an upper portion of the throughbore 60. In other embodiments, the vent seal 24 may radially cover the vent 54, for instance, by covering the upper portion of the throughbore 60. Also, the container seal 22 and the vent seal 24 may be connected via an extension portion 23 extending through a passage or runner 68 between the upper and lower surfaces 56, 58 of the lid 20. Accordingly, the container seal 22 and the vent seal 24 effectively may constitute one component coupled to the lid 20. The seal 16 may be composed of a polymeric or elastomeric material, for example, any thermoplastic elastomer (TPE) suitable for use in sealing containers for food products, for instance, GLS VERSAFLEX, available from PolyOne of Avon Lake, Ohio.

The seal 16 may be coupled to the lid 20 by integral molding, adhesive, welding, coupled mechanically using interlocking tabs, slots, pins, holes, or other fasteners, interference-fit assembly, or in any other suitable manner. In one particular example, the container seal 22 and/or the vent seal 24 may be overmolded (or insert molded) or co-molded (or co-injection molded) to the lid 20, or molded according to any other suitable molding method(s). If co-molding, overmolding, or like methods are used, it is generally desirable that the polymer used to form the seal 16 be compatible with, and perhaps capable of adhering to, the polymer used to form the lid 20. The seal material generally cannot be removed from the lid material without damage and remains durable for the lifetime of the closure.

With continued reference to FIG. 2, the product P may be introduced into the container 12 while hot, and then the closure 14 is rotatably coupled to the container 12 and tightened thereto such that the closure lid 20 becomes sandwiched between the container 12 and the closure overcap 18, wherein the vent 54 becomes sealed by way of compression of the vent seal 24 between the overcap 18 and the lid 20. As the product P cools, it shrinks, thereby establishing a vacuum condition inside the package 10. Ordinarily, such a vacuum can render it particularly difficult to remove a closure from a container, but with the presently disclosed package 10, the vent 54 assists with closure removal as described below.

Figure 3:
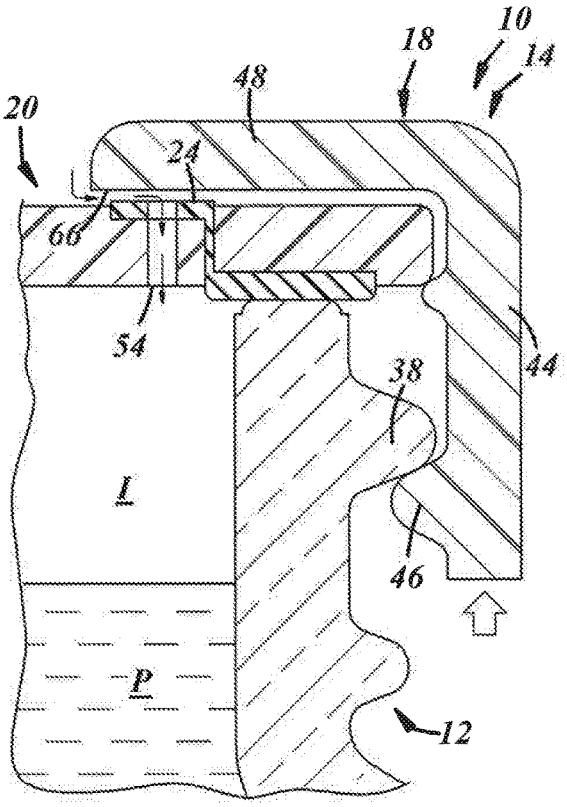
FIG. 3 is a fragmentary sectional view like that of FIG. 2, but illustrating the package in a vented condition.
Figure 4:
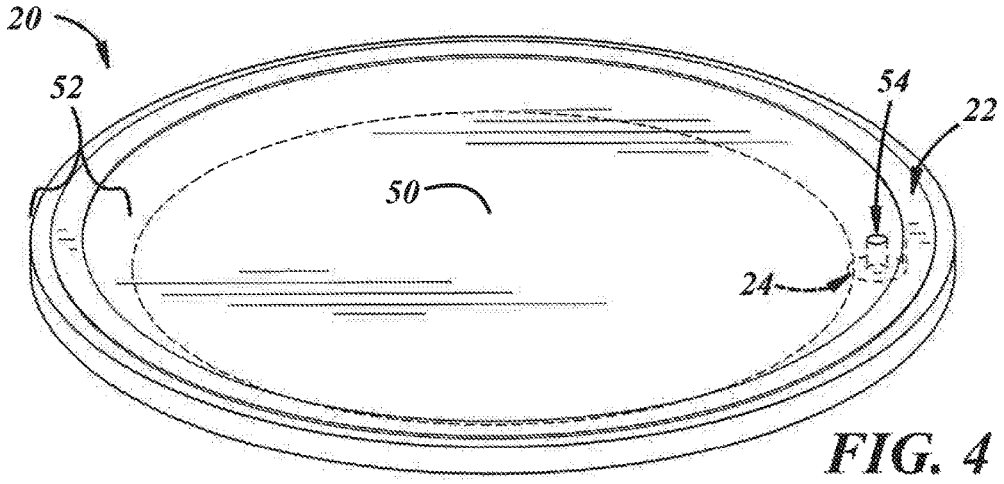
FIG. 4 is a bottom view of the closure lid of FIG. 1.

With reference to FIG. 3, the closure 14 is adapted for vacuum venting of the package 10 upon initial rotational removal of the closure 14 from the container 12, for instance, over 12 to 22 degrees of angular/circumferential rotation including all ranges, subranges, and values therebetween, for example, about 18 degrees, e.g., 17-19 degrees. In one example, there may be about 11 (eleven) degrees of lost motion between threads when removing the overcap 18 from the container 12, and about 7 (seven) degrees of decompression of one or both of the seals 22, 24. As the closure 14 is rotated with respect to the container 12 in a removal direction, the lid 20 tends to remain in place but the securement elements 38, 46 cooperate to lift the closure overcap 18 away from the container 12 such that the lower surface 66 of the overcap flange 48 will start to disengage from the vent seal 24, thereby opening the vent 54 to allow external air to enter the package interior I and render it easier to continue removal of the closure 14.

Figure 5:
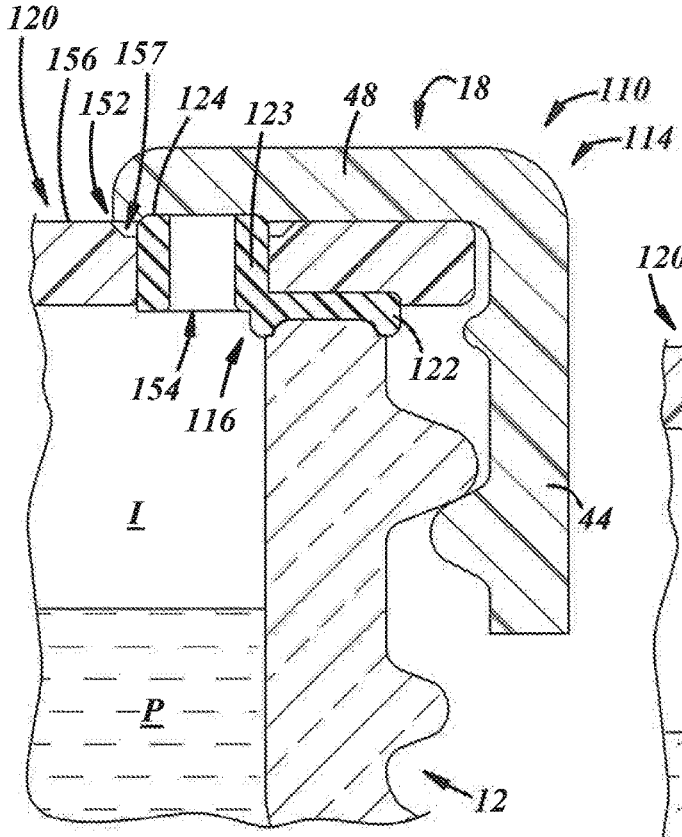
FIG. 5 is a fragmentary sectional view of a package in accordance with another illustrative embodiment of the present disclosure, shown in a sealed mode, and including the container of FIG. 1 and another closure for the container including another closure lid and the closure overcap of FIG. 1.
Figure 6:
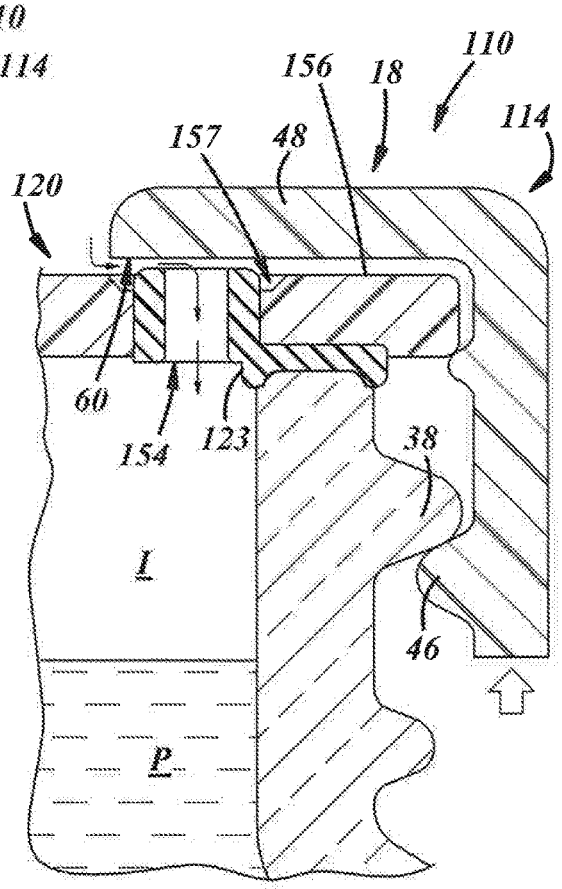
FIG. 6 is a fragmentary sectional view of the package of FIG. 5, illustrating the package in a vented condition.
Figure 7:
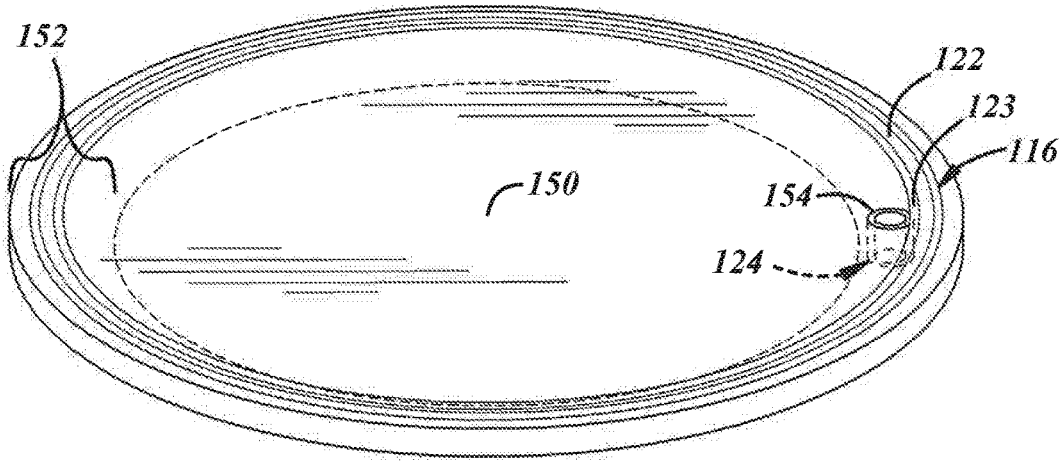
FIG. 7 is a bottom view of the closure lid of FIG. 5.

FIGS. 5-7 show another illustrative embodiment of a package 110. This embodiment is similar in many respects to the embodiments of FIGS. 1-4 and like numerals among the embodiments generally designate like or corresponding elements throughout the several views of the drawing figures. Accordingly, the descriptions of the embodiments are incorporated into one another, and the description of subject matter common to the embodiments generally may not be repeated here.

With reference to FIG. 5, the package 110 includes a closure 114 coupled to the container 12 and including a seal 116 carried by a lid 120. With additional reference to FIG. 7, the seal 116 includes a container seal 122 substantially similar as that of the previous embodiment. The seal 116 also includes a vent seal 124 that is different from the embodiments of FIGS. 1-4 in that it is basically a cylindrical member extending through a substantially cylindrical vent 154, and an extension 123 connecting the container seal 122 and vent seal 124 and which may be a portion of the cylindrical vent seal 124. An upper portion of the vent seal 124 may project into a corresponding pocket 157 in an upper surface 156 of the lid 120, and may project axially beyond the upper surface 156 or a plane established thereby. The pocket 157 may have a flat surface through which the seal 124 extends, and a chamfered surface between the flat surface and the upper surface 156 of the lid 120. Accordingly, those of ordinary skill in the art will appreciate that the upper end of the seal 124 will be compressed somewhat by the closure 114 within the pocket 157 when the closure 114 is fully applied to the container 12.

With reference to FIG. 6, as the closure 114 is rotated in a removal direction, the lid 120 tends to remain in place but the cooperating securement elements 38, 46 will lift the closure overcap 18 away from the container 12 such that the lower surface 66 of the overcap flange 48 will start to disengage from the vent seal 124, thereby opening the vent 154 to allow external air to enter the package interior I and render it easier to continue removal of the closure 114.

Figure 8:
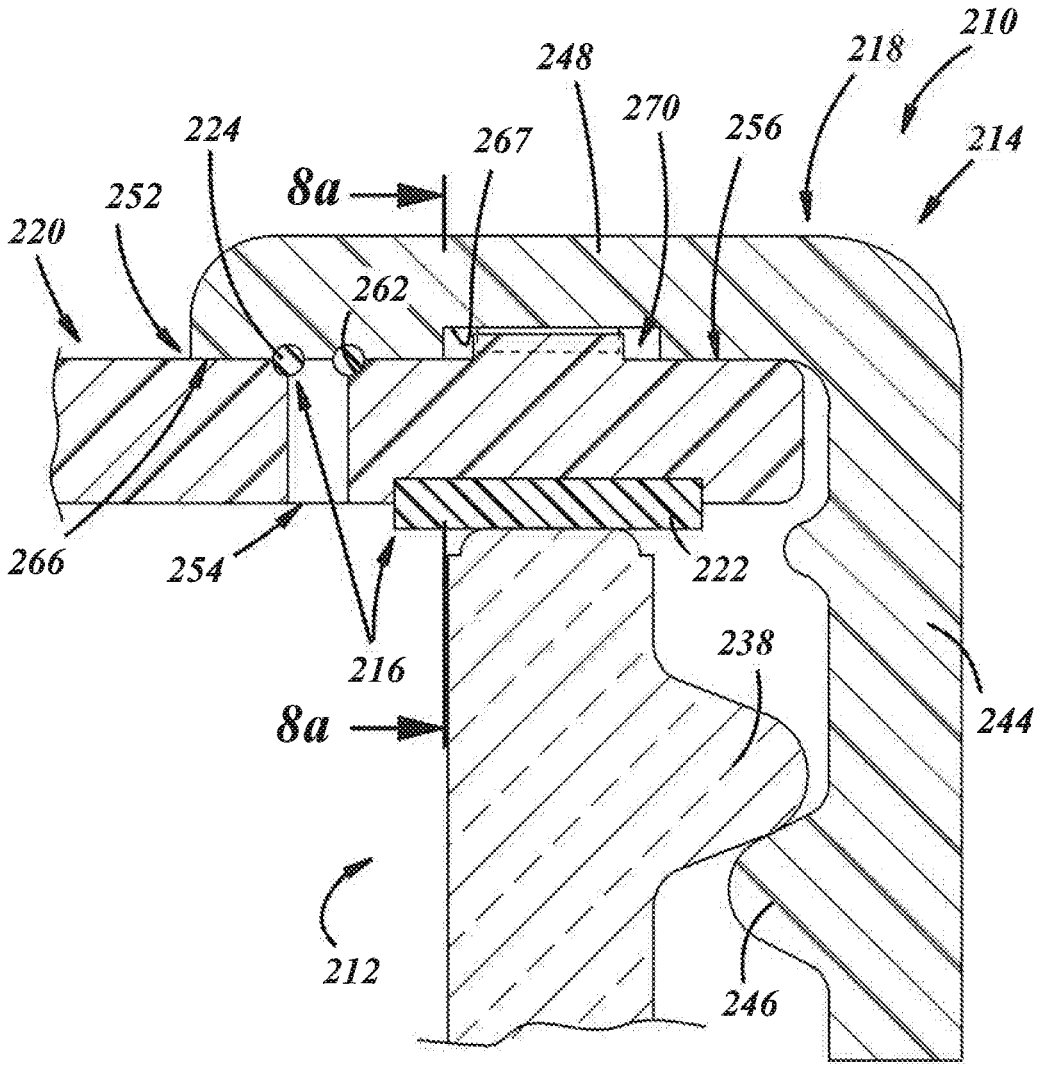
FIG. 8 is a fragmentary sectional view of a package in accordance with an additional illustrative embodiment of the present disclosure, shown in a sealed mode, and including an additional container, and an additional closure for the container including an additional closure lid and an additional closure overcap.
Figure 9:
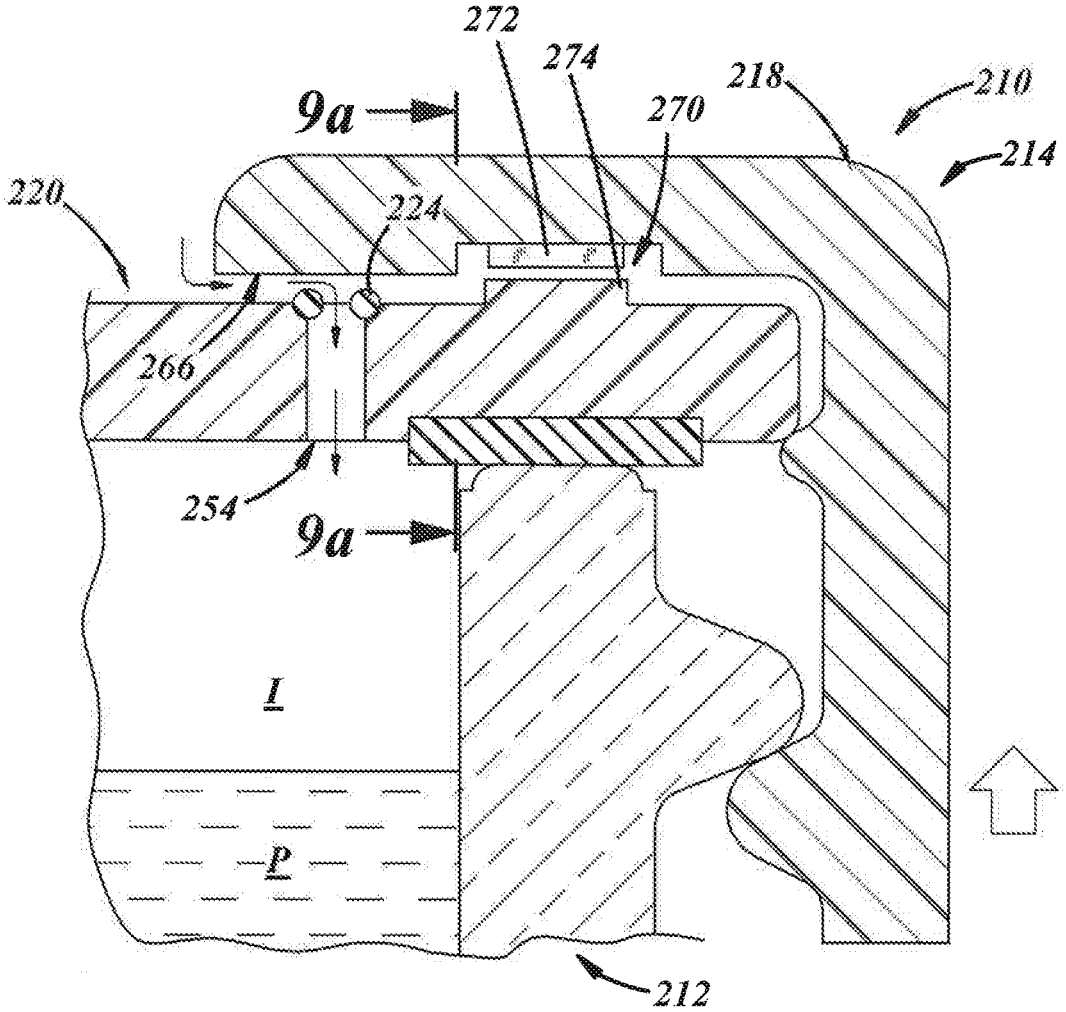
FIG. 9 is a fragmentary, sectional view of the package of FIG. 8, but shown in a vented mode.
Figure 10:
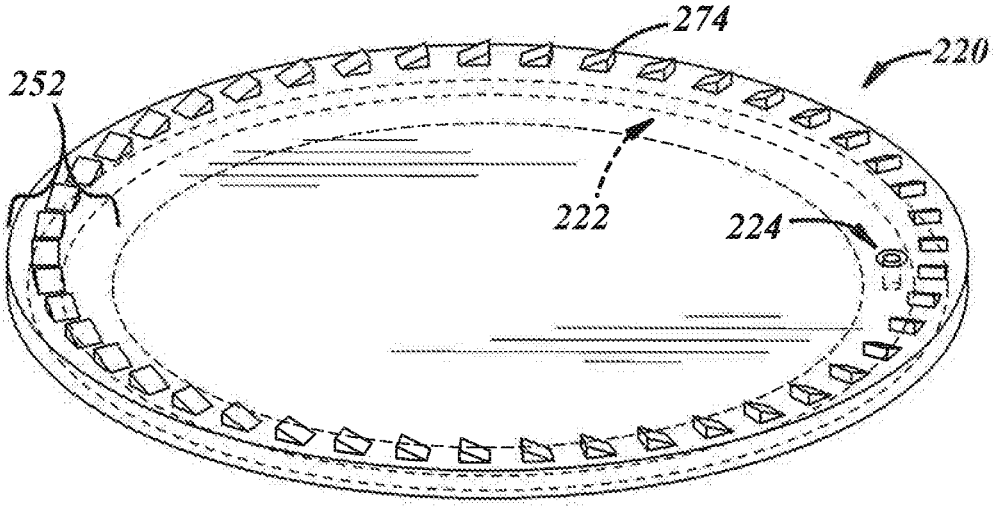
FIG. 10 is a bottom perspective view of the closure lid of FIG. 8.

FIGS. 8-10 show another illustrative embodiment of a package 210. This embodiment is similar in many respects to the embodiments of FIGS. 1-7 and like numerals among the embodiments generally designate like or corresponding elements throughout the several views of the drawing figures. Accordingly, the descriptions of the embodiments are incorporated into one another, and the description of subject matter common to the embodiments generally may not be repeated here.

With reference to FIG. 8, the package 210 includes a closure 214 coupled to a container 212, for example, via snap fit. For instance, the container 212 may include a snap bead 238 and an overcap 218 of the closure 214 may include a corresponding snap bead 246 for snap fit cooperation with the container snap bead 238. The closure 214 also includes a seal 216 carried by a lid 220. The seal 216 includes a container seal 222 substantially the same as that of the previous embodiments. The seal 216 also includes a vent seal 224 that is different from the previous embodiments in that it is basically an O-ring that may be carried in a corresponding pocket 262 in an upper surface 256 of the lid 220 and at the top of a substantially cylindrical vent 254. In another embodiment, the vent seal 224 instead may be carried by the lower surface 266 of the overcap 218. In this embodiment, there is no extension connecting the container seal 222 and the vent seal 224, in that the ring 222 and seal 224 are separate components. But this embodiment includes cooperating lugs 270. The lugs 270 may extend within an annular pocket 267 in the lower surface 266 of the overcap 218.

Figure 8A:
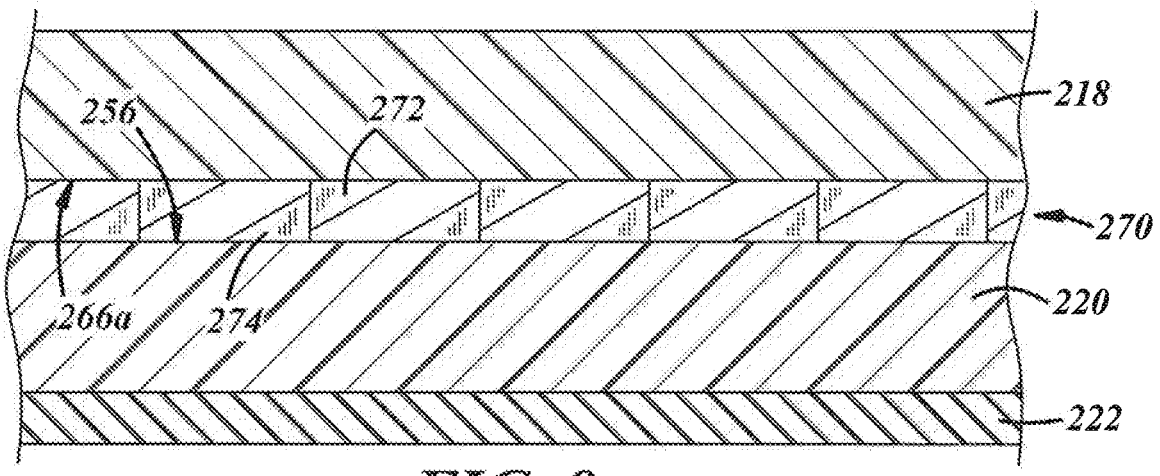
FIG. 8*a* is an enlarged, fragmentary, sectional view of the package of FIG. 8, taken from line 8*a*-8*a* thereof.

With reference to FIG. 8*a*, the lugs 270 include overcap lugs 272 projecting away from a lower surface 266*a* of the overcap 218, and lid lugs 274 projecting away from the upper surface 256 of the lid 220. As shown in FIG. 8*a*, the lugs 272, 274 have ramps that may face axially and circumferentially, and abutments that may face circumferentially and that are shown contacting one another. With reference to FIG. 10, the lid lugs 274 are provided at a radially outer margin 252 of the lid 220, spaced circumferentially around the lid 220, radially outboard of the vent seal 224, and radially overlapping the container seal 222 that is on the opposite side of the lid 220.

Figure 9A:
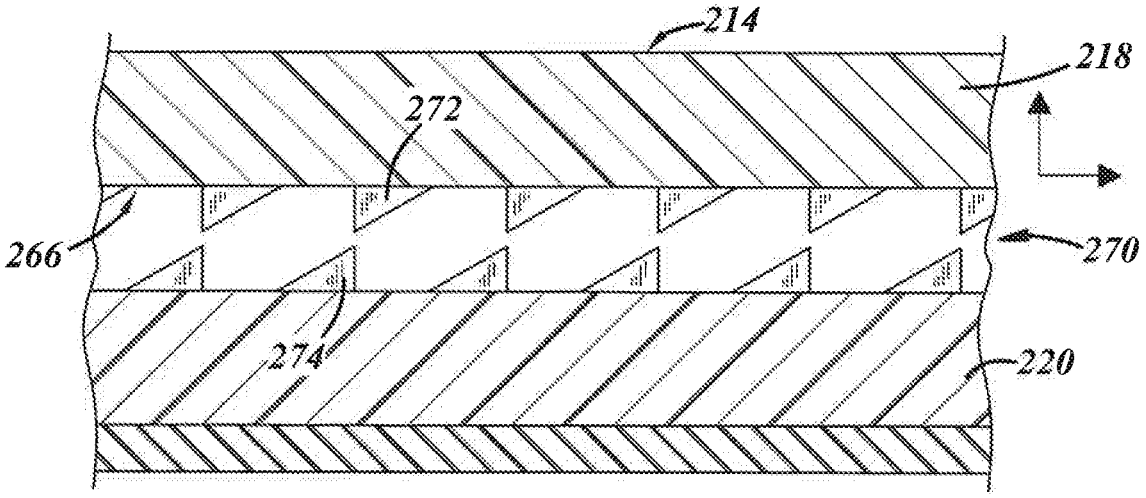
FIG. 9*a* is an enlarged, fragmentary, sectional view of the package of FIG. 9, taken from line 9*a*-9*a* thereof.

With reference to FIGS. 9 and 9*a*, the closure 214 is adapted for vacuum venting of the package 210 upon initial rotational removal of the closure 214 from the container 212, for instance, over 2 to 10 degrees of angular/circumferential rotation including all ranges, subranges, and values therebetween, for example, about 6 degrees, e.g., 4-8 degrees. When the closure 214 is rotated in a removal direction with respect to the container 212, the ramps of the overcap lugs 272 ride on the ramps of the lid lugs 274. The cooperation of the lugs 272, 274 in this manner causes the overcap 218 to move or deflect axially such that the lower surface 266 of the overcap base 248 will start to disengage from the vent seal 224, thereby opening the vent 254 to allow external air to enter the package interior I and render it easier to continue removal of the closure 214. Accordingly, as the closure 214 is rotated with respect to the container 212 in a removal direction, the lid 220 tends to remain in place but the lugs 272, 274 cooperate to lift the closure overcap 218 away from the container 212, thereby opening the vent 254 to allow external air to enter the package interior I and render it easier to continue removal of the closure 214.

Figure 11:
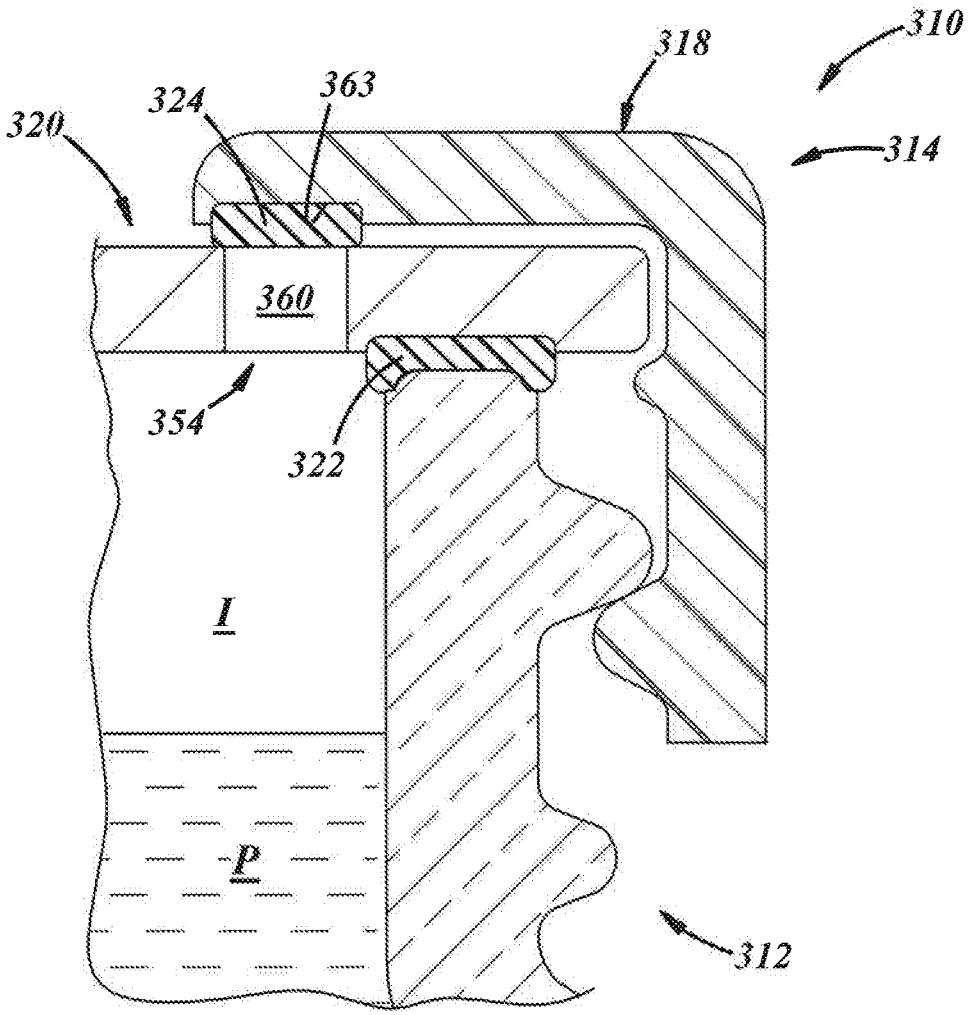
FIG. 11 is a fragmentary sectional view of a package in accordance with a further illustrative embodiment of the present disclosure, shown in a sealed mode, and including a further closure for the container including a further closure lid and a further closure overcap.

FIG. 11 shows another illustrative embodiment of a package 310. This embodiment is similar in many respects to the embodiments of FIGS. 1-10 and like numerals among the embodiments generally designate like or corresponding elements throughout the several views of the drawing figures. Accordingly, the descriptions of the embodiments are incorporated into one another, and the description of subject matter common to the embodiments generally may not be repeated here.

With reference to FIG. 11, the package 310 includes a closure 314 coupled to a container 312 holding a product P in an interior I of the package 310. The closure 314 may include an overcap 318 and a lid 320, and the lid 320 may have a vent 354, which may include a throughbore 360. Also, the closure 314 may include a seal, which may be carried by the lid 320 and may be comprised of a container seal 322 that may be circumferentially continuous. The closure seal also may be comprised of a vent seal 324 that may be separate from the container seal 322, that may radially cover the vent 354, and that may be carried by the overcap 318, for example, in a pocket 363 in an undersurface of the overcap 318. More specifically, the vent seal 324 may be overmolded to an annular flange of the overcap 318. In other embodiments, the vent seal 324 may be a component produced separately from the overcap 318 and assembled thereto.

Figure 12:
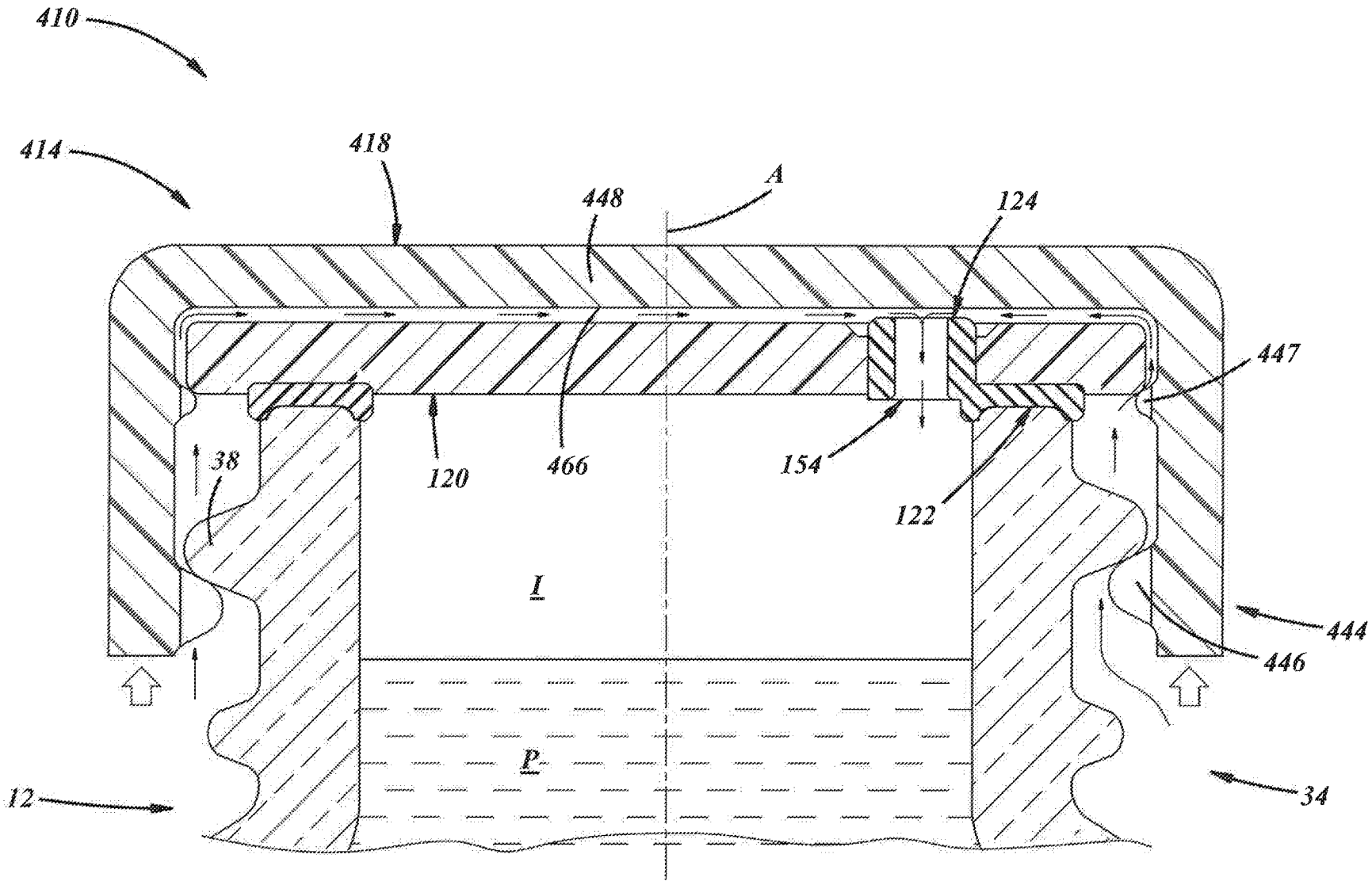
FIG. 12 is a fragmentary sectional view of a package in accordance with another illustrative embodiment of the present disclosure, shown in a vented mode, and including another closure for the container including another closure lid and another closure overcap.

FIG. 12 shows another illustrative embodiment of a package 410. This embodiment is similar in many respects to the embodiments of FIGS. 1-11 and like numerals among the embodiments generally designate like or corresponding elements throughout the several views of the drawing figures. Accordingly, the descriptions of the embodiments are incorporated into one another, and the description of subject matter common to the embodiments generally may not be repeated here.

With reference to FIG. 12, the package 410 includes a closure 414 coupled to the container 12 having one or more securement elements 38. The closure 414 may include an overcap 418 and a lid 120, which may be the lid 120 illustrated in FIGS. 5-7 including the vent 154. Also, the closure 414 may include a seal, which may be carried by the lid 120 and may be comprised of the container seal 122 that may be circumferentially continuous. The closure seal also may be comprised of the vent seal 124 that may be separate from the container seal 122.

The overcap 418 has an annular skirt 444 with one or more internal, or radially inwardly extending, container securement elements 446 for engagement with the external securement element(s) 38 on the finish 34 of the container 12. The overcap 418 also has a radially inwardly directed wall extending radially inwardly from the annular skirt 444, and may be an imperforate base wall 448 that transversely extends, completely and continuously, radially across the central longitudinal axis. The overcap 418 further has a radially inwardly directed retainer 447 extending radially inwardly from the skirt 444 between the securement elements 446 and the wall 448 to retain the closure lid 120 to the overcap 418. The retainer 447 may include one or more radially inwardly extending beads, steps, shoulders, or the like. The securement elements 446 and the retainer 447 may be circumferentially interrupted, circumferentially spaced, or the like, so as to establish one or more gaps therebetween that may provide one or more vent paths.

As the closure 414 is rotated in a removal direction, the lid 120 tends to remain in place but the cooperating securement elements 38, 446 will lift the closure overcap 418 away from the container 12 such that a lower surface 466 of the overcap wall 448 will start to disengage from the vent seal 124, thereby opening the vent 154 to allow external air to flow through the one or more vent paths established by gaps in the retainer 447 and/or the securement elements 446, between the lid 120 and the overcap 418, and enter the package interior I and render it easier to continue removal of the closure 414.

There thus has been disclosed a package that fully satisfies one or more of the objects and aims previously set forth. The disclosure has been presented in conjunction with an exemplary embodiment, and modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A closure that includes:
- an overcap, including:
  - an annular skirt extending along a longitudinal axis, and
  - an annular wall extending radially inwardly from the annular skirt;
- a lid carried by the overcap radially within the annular skirt, and including:
  - a hub, and
  - an annular margin extending radially outwardly with respect to the hub, and having upper and lower surfaces; and
- an annular container seal extending circumferentially continuously around the annular margin,
- wherein the lid further includes one or more vents extending through the annular margin between the upper and lower surfaces thereof at one or more discrete circumferential locations, and wherein the container seal is disposed radially outwardly with respect to the one or more vents, and the closure further includes one or more vent seals disposed at the one or more vents between the lid and the overcap.

2. The closure set forth in claim 1 wherein the annular wall is an annular flange establishing a central aperture of the overcap, and wherein the annular margin of the lid is overlapped by the annular flange and is established radially outwardly of the central aperture of the overcap.

3. The closure set forth in claim 1 wherein the overcap is composed of a polymeric material, the lid is composed of a transparent polymeric material, and the container seal is composed of a thermoplastic elastomer material.

4. The closure set forth in claim 1 wherein the container seal is connected to the one or more vent seals via one or more passages extending through the lid.

5. The closure set forth in claim 1 wherein the one or more vent seals extends through the vent from one side of the lid to another side of the lid.

6. The closure set forth in claim 1 wherein the container seal and the one or more vent seals are connected to one another at a lower surface of the lid.

7. The closure set forth in claim 1 wherein the container seal and the one or more vent seals are separate, and not connected to one another.

8. The closure set forth in claim 1 wherein the one or more vent seals is an O-ring.

9. A closure that includes:
- an overcap, including:
  - an annular skirt extending along a longitudinal axis, and
  - an annular wall extending radially inwardly from the annular skirt;
- a lid carried by the overcap radially within the annular skirt, and including:

a hub, and an annular margin extending radially outwardly with respect to the hub, and having upper and lower surfaces; and an annular container seal extending circumferentially continuously around the annular margin wherein a lower surface of the overcap includes a first lug and an upper surface of the lid includes a corresponding second lug for cooperation with the first lug to displace the overcap from the lid.

10. The closure set forth in claim 9 wherein the lugs include cooperating ramps.

11. The closure set forth in claim 9, wherein the lower surface of the overcap includes a plurality of the first lug circumferentially spaced and the upper surface of the lid includes a corresponding plurality of the second lug circumferentially spaced for cooperation with the plurality of the first lug to displace the overcap from the lid.

12. The closure set forth in claim 1 wherein the annular container seal is carried by the annular margin at the lower surface thereof, and the one or more vent seals is carried by the annular margin at the upper surface thereof.

13. The closure set forth in claim 1 wherein the annular container seal is carried by the annular margin at the lower surface thereof, and the one or more vent seals is carried by the annular flange.

14. A package, comprising:

a container including an axially facing sealing surface; and a multi-piece closure coupled to the container and including:

an overcap, including:

an annular skirt extending along a longitudinal axis for coupling the closure to a container, and an annular wall extending radially inwardly from the annular skirt;

a lid carried by the overcap radially within the annular skirt, and including:

a hub, an annular margin extending radially outwardly with respect to the hub, and having upper and lower surfaces, and one or more vents extending through the annular margin between the upper and lower surfaces thereof at one or more discrete circumferential locations;

an annular container seal disposed radially outwardly with respect to the one or more vents and extending circumferentially continuously around the annular margin; and one or more vent seals disposed at the one or more vents between the lid and the overcap, for sealing the one or more vents between the lid and the overcap annular flange.

15. The package set forth in claim 14 wherein the annular wall is an annular flange establishing a central aperture of the overcap, and wherein the annular margin of the lid is overlapped by the annular flange and is established radially outwardly of the central aperture of the overcap.

16. The package set forth in claim 14 wherein the container includes at least one container thread segment and the overcap of the closure includes at least one closure thread segment for threaded cooperation with the at least one container thread.

17. The package set forth in claim 14 wherein the container seal and the one or more vent seals are connected to one another at a lower surface of the lid.

18. The package set forth in claim 14 wherein the container seal and the one or more vent seals are separate, and not connected to one another.

19. The package set forth in claim 14 wherein the container includes at least one container snap bead and the overcap of the closure includes a corresponding closure snap bead for snap fit cooperation with the container snap bead.

20. The package set forth in claim 14 wherein a lower surface of the overcap includes a first lug and an upper surface of the lid includes a corresponding second lug for cooperation with the first lug to displace the overcap from the lid to open the vent.

21. The package set forth in claim 19 wherein the lugs include cooperating ramps.

22. The package set forth in claim 19, wherein the lower surface of the overcap includes a plurality of first lug circumferentially spaced and the upper surface of the lid includes a corresponding plurality of the second lug circumferentially spaced for cooperation with the plurality of the first lug to displace the overcap from the lid to open the vent.

23. The package set forth in claim 14, wherein upon initial rotational removal of the closure from the container, the one or more vent seals become unseated.

24. The closure set forth in claim 1, wherein the overcap is rotatable with respect to the lid so as to unseat the one or more vent seals.

25. A closure lid, comprising:

a hub;

an annular margin extending radially outwardly with respect to the hub, and having upper and lower surfaces;

one or more vents extending through the annular margin between the upper and lower surfaces thereof at one or more discrete circumferential locations;

an annular container seal disposed radially outwardly with respect to the one or more vents and extending circumferentially continuously around the annular margin; and one or more vent seals disposed at the one or more vents and connected to the annular container seal at the lower surface of the annular margin.

26. The closure lid set forth in claim 25, wherein the container seal and the one or more vent seals are overmolded, insert molded, co-molded, or co-injection molded to the annular margin.

* * * * *